United States Patent [19]

Bedford

[11] 4,453,469

[45] Jun. 12, 1984

[54] TROLLEY STOP FOR TRACK SWITCH

[76] Inventor: Beryl A. Bedford, 701 Hurlingame Ave., Redwood City, Calif. 94063

[21] Appl. No.: 365,254

[22] Filed: Apr. 5, 1982

[51] Int. Cl.[3] ..... E01B 25/26; B61K 7/20

[52] U.S. Cl. ..... 104/100; 104/250

[58] Field of Search ..... 104/96–105, 104/249, 250, 252

[56] References Cited

U.S. PATENT DOCUMENTS

| | | | |
|---|---|---|---|
| 301,119 | 7/1884 | Haskins et al. | 104/103 |
| 1,094,037 | 4/1914 | Tye | 104/250 X |
| 1,171,748 | 2/1916 | Normine | 104/250 X |
| 1,180,080 | 4/1916 | Rothe | 104/250 X |
| 2,853,955 | 9/1958 | Bishop et al. | 104/103 X |
| 4,014,269 | 3/1977 | Bedford | 104/250 |

*Primary Examiner*—Randolph Reese

*Attorney, Agent, or Firm*—Harvey B. Jacobson

[57] ABSTRACT

A trolley stop device for use in an overhead track and trolley system in which there is a track switch such as those frequently used in slaughter houses and the like. Such systems include a main track and a branch track with a track switch by which a trolley may move along the main track in one direction and pass through the switch when it is in one position and the trolley then reversed and passed through the switch when in its other position for movement of the trolley onto the branch track as is well known in this field of endeavor. The trolley stop is a spring biased stop pivotally mounted on the main track adjacent the portion thereof which has a notch or cut-out receiving the track switch elements so that at any time one or the other of the switch elements are not in their operative or closed position, the trolley stop will prevent the trolley from rolling off the main track at the open end thereof defined by the notch or cut-out. The stop includes a projection to limit its pivotal movement to a position in the path of movement of the trolley and includes a beveled end to partially enter the groove between the flanges on the trolley wheel.

4 Claims, 7 Drawing Figures

TROLLEY STOP FOR TRACK SWITCH

BACKGROUND OF THE INVENTION

1. Field of the Invention

The present invention generally relates to a trolley stop for an overhead track system to prevent the trolley from rolling off the end of a track when a switch element is not in operative relationship to the end of the track in which the stop is spring biased to its operative position and is cammed toward its inoperative position when either of the track switch elements are operatively associated with the end of the track.

2. Description of the Prior Art

My prior U.S. Pat. No. 4,014,269, issued Mar. 29, 1979 discloses a gravity operated type of trolley stop used in an overhead track system and my prior U.S. Pat. No. 3,739,727, issued June 19, 1973 discloses an automatic switch for overhead track systems. Overhead track systems and switches incorporated therein are well known in various industries and various prior patents disclose such structures including the above-mentioned patents and the prior art of record in those patents. In addition, the following U.S. patents are relevant to trolley stops:

U.S. Pat. No. 301,119, H. S. Haskins et al.
U.S. Pat. No. 989,899, H. L. Ferris
U.S. Pat. No. 891,493, R. B. & W. Louden
U.S. Pat. No. 967,869, J. C. Fitzgerald
U.S. Pat. No. 1,155,214, E. E. Conrad
U.S. Pat. No. 1,878,605, O. C. Schmidt et al.

The above patents disclose various types of trolley stops but none of them discloses a structure equivalent to the present invention.

SUMMARY OF THE INVENTION

An object of the present invention is to provide a safety stop associated with an overhead track system having a trolley rollingly supported thereon and a switch assembly by which the trolley can move along various portions of the track system with the safety stop automatically moving into a position to stop the trolley from rolling off the end of a track when a switch element is not in registry with the end of the track.

Another object of the invention is to provide a trolley stop in accordance with the preceding object in which the trolley stop is spring biased to a position preventing the trolley from rolling off the end of a track when the switch element or elements are not in closed position.

A further object of the invention is to provide a trolley stop in accordance with the preceding objects in which the stop includes a projection for limiting pivotal movement thereof in one direction for accurate alignment with and registry with the trolley and the end of the stop having a configuration to enable it to partially enter the space between the flanges on the trolley wheel thereby assuring proper engagement of the stop with the trolley.

Still another object of the present invention is to provide a trolley stop for use in combination with an overhead track system such as those used to movably support animal carcasses or portions thereof in slaughter houses and the like which is simple in construction, easy to install, effective and dependable in preventing a trolley from rolling off the end of a track and automatic in operation with the trolley stop being constructed and configured such that it will assume its trolley stopping position before either of the switch elements have moved to a position to enable the trolley to roll off the track.

These together with other objects and advantages which will become subsequently apparent reside in the details of construction and operation as more fully hereinafter described and claimed, reference being had to the accompanying drawings forming a part hereof, like numerals refer to like parts throughout.

DESCRIPTION OF THE PREFERRED EMBODIMENT

Figure 7:
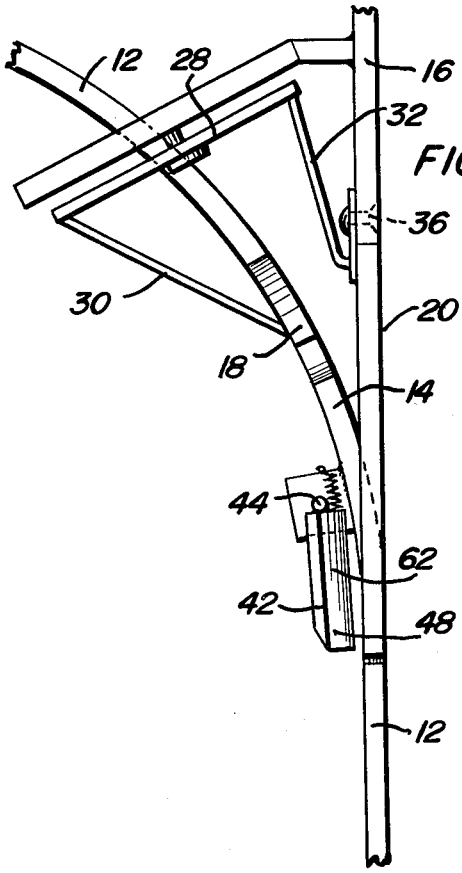
FIG. 7 is a fragmental plan view similar to FIG. 1 illustrating the straight switch element in closed position.

Referring now to the drawings, the trolley stop of the present invention is generally designated by reference numeral 10 and is illustrated in association with an overhead track system which includes a curved track section 12 which is continuous and considered the main track section with a portion of the curved track section 12 including a notch or cut-out area 14 which extends longitudinally in the top edge thereof. Associated with the curved track section is a straight track section 16 considered the branch section which is generally tangentially related to and spaced from the curved track section 12. The track system includes a curved switch element 18 and a straight switch element 20 which are selectively positioned in the notch 14 with the curved switch element 18 completely filling and conforming with the notch 14 when it is positioned therein so that the upper surface of the curved switch element forms a continuation of the upper surface of the curved track section 12 so that a trolley 22 having a flanged wheel 24 may roll thereon with the trolley shackle 26 depending therefrom in a conventional manner. When the curved switch element 18 is pivoted upwardly out of the notch 14 and the straight switch element 20 is pivoted downwardly so that the terminal end portion thereof is aligned with the corresponding end portion of the notch 14, the upper surface of the straight switch element 20 will be continuous with the upper surface of the straight track section 16 and the portion of the curved track section 12 as illustrated in FIG. 7. The track sections 12 and 16 may be reversed as to which is the main and branch track and which has the notch.

Figure 1:
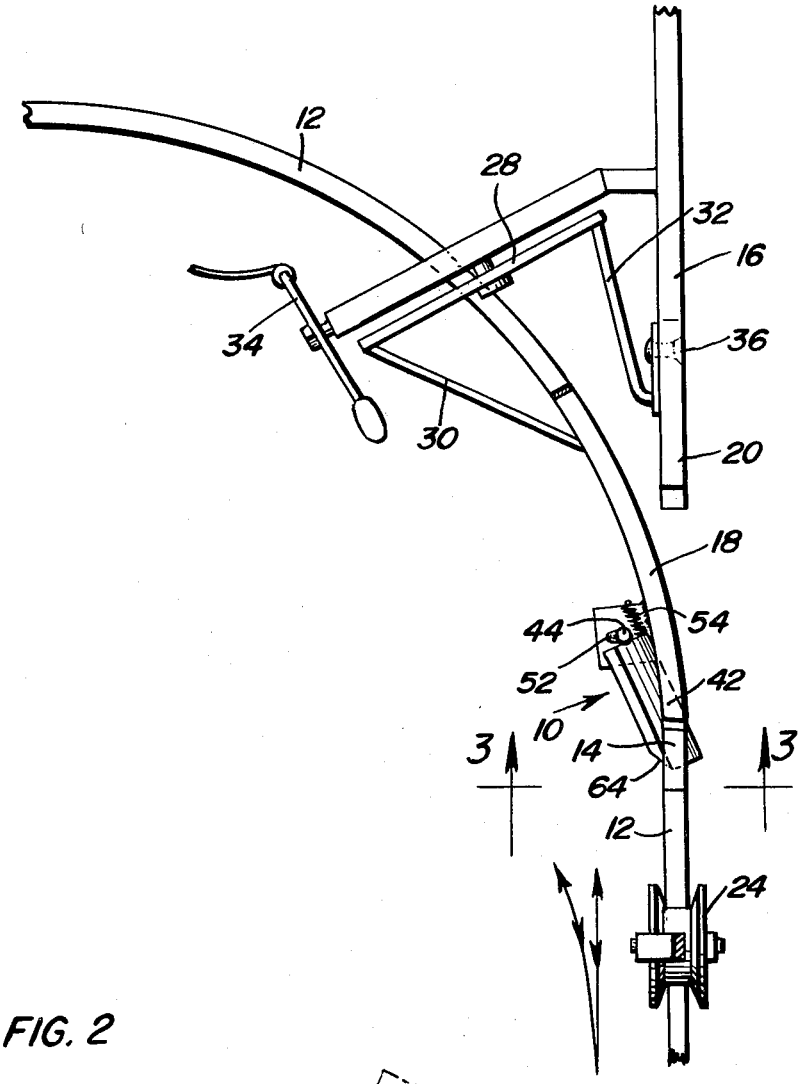
FIG. 1 is a fragmental plan view of an overhead track system and illustrating the trolley stop of the present invention associated therewith.
Figure 2:
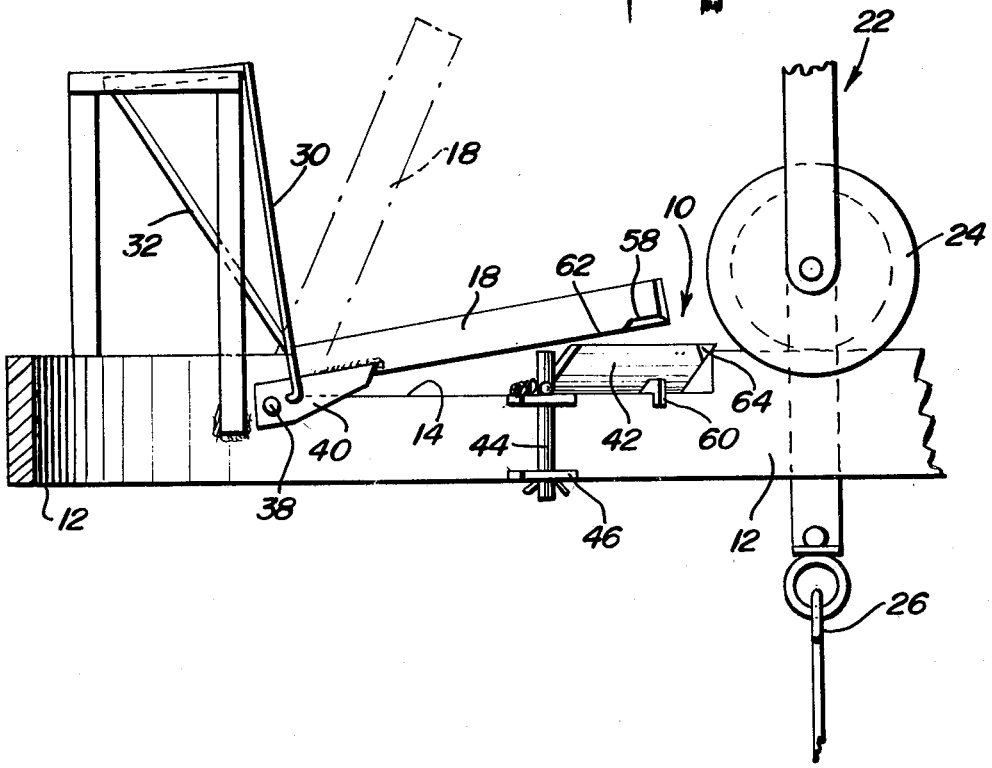
FIG. 2 is a side elevational view of the construction of FIG. 1.

The trolley 22 can move along the curved track section 12 in the direction of the arrow in FIG. 1, through the switch assembly defined by the switch elements 18 and 20 and the notch 14 and after the trolley passes over the closed curved switch element 18, mechanism is operated to open the curved switch element 18 and close the straight switch element 20 so that the trolley 22 can then be reversed and moved in the direction of the arrow in FIG. 1 onto the straight track section or branch track section 16 or the trolley may move in an opposite mode. The operating mechanism for the switch elements 18 and 20 is also conventional and basically includes a pivot bar or beam 28 having linkage 30 connected to the curved switch element 18 and linkage 32 connected to the straight switch element 20 with an operating mechanism 34 being provided to oscillate the bar or beam 28 either manually or automatically with this structure also being conventional and well known and forming no particular part of the present invention. Also, the straight switch element 20 is pivotally supported from the straight track section 16 by a pivot bolt, rivet, or other suitable pivot means 36 and likewise, the curved switch element 18 is pivotally supported from the curved track section 12 by a pivot bolt, rivet or similar means 38 which extends through offset lugs 40 attached to the lower edge portion and forming an extension of the curved switch element 18 to enable it to properly swing from its closed position within the notch 14 to an open position with its free or swinging end elevated above the curved track section 12 as illustrated by the dotted line position thereof in FIG. 2. All of the aforementioned structure is conventional in of itself and forms no particular part of the present invention which is directed essentially to the trolley stop 10 and its association with the conventional components of the curved track section 12, the straight track section 16 and the curved switch element 18 and the straight switch element 20 as well as the trolley 22 and the trolley wheel 24 rollingly supporting the trolley from the track sections 12 and 16.

Figure 3:
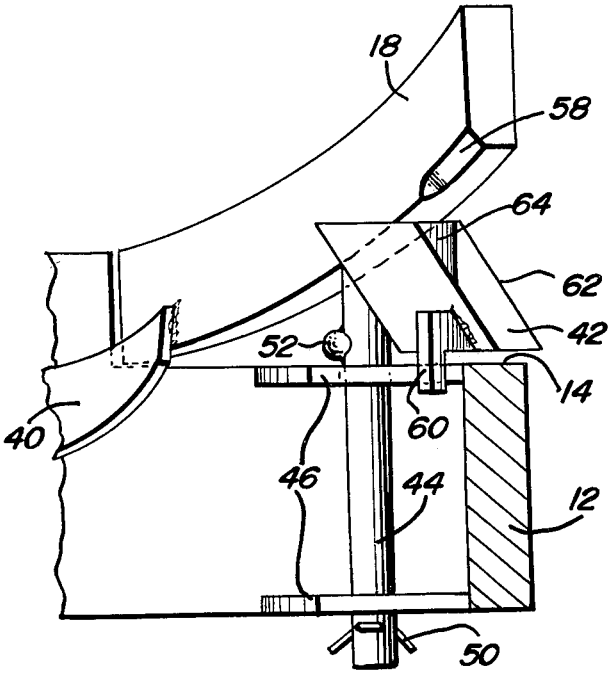
FIG. 3 is a sectional view taken substantially upon a plane passing along section line 3—3 of FIG. 1 illustrating the association of the trolley stop with the curved switch element and the notch in the curved track section.
Figure 4:
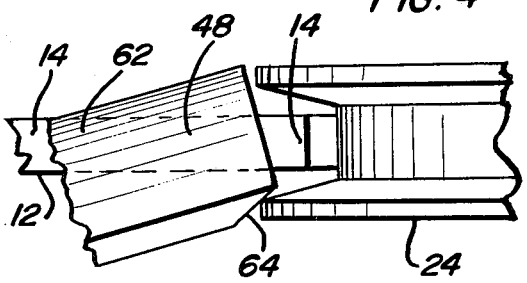
FIG. 4 is a fragmentary plan view illustrating the association of the end of the stop and the flanges on the trolley wheel when the stop engages the trolley.

The trolley stop 10 includes a relatively short bar 42 having one end thereof welded to a vertical shaft or pin 44 that extends through and is rotatably journalled in a pair of vertically spaced lugs 46 extending horizontally from the concave surface of the curved track section 12 adjacent to but spaced from the end of the notch 14 remote from the pivot pin 38. This structure enables the stop bar 42 to swing in a horizontal plane about a vertical axis defined by the pin 44 journalled in the lugs 46 with the opposite end of the bar 42 as designated by the numeral 48 oriented so that it is disposed above the track surface of the curved track section 12 when it is swung inwardly into the notch 14 which is its operative position since it is positioned in the path of and will engage the trolley wheel 24 when the trolley wheel approaches the notch 14 thereby preventing the trolley wheel running off the open end of the track defined by the end of the notch 14 remote from the pivot pin 38 as illustrated in FIG. 4. The pivot pin 44 is provided with a retainer 50 at the lower end thereof to preclude upward movement of the pin through the lugs 46 and a projection 52 is provided on the pin above the upper lug 46 to vertically position the pin 44 in relation to the lugs. Also, a tension coil spring 54 is connected to the inner corner area of the stop bar 42 adjacent the pin 44 with the terminal end of the spring 54 being connected to a pin or other suitable structure 56 on the upper lug 46 to bias the stop bar 44 so that it will be spring urged toward a position overlying a portion of the upper edge of the notch 14 as illustrated in solid line in FIGS. 4 and 5 with the stop bar 42 being capable of being swung horizontally towards its dotted line position illustrated in FIG. 5 when either of the switch elements 18 or 20 are pivoted downwardly into the notch 14 with the swinging end portion of each of the switch elements camming the stop bar 42 towards its dotted line position and the lower corner of each switch element may be beveled as at 58 as shown in FIG. 3 to facilitate this camming action. The lower edge of the stop bar 42 is provided with a projecting lug 60 depending from the side thereof outwardly of the main track section so that it will engage the main track section 12 adjacent the upper edge of the notch 14 to limit the horizontal swinging movement of the stop bar 42 to position the stop bar 42 accurately in its operative position as illustrated in FIGS. 3–5.

Figure 5:
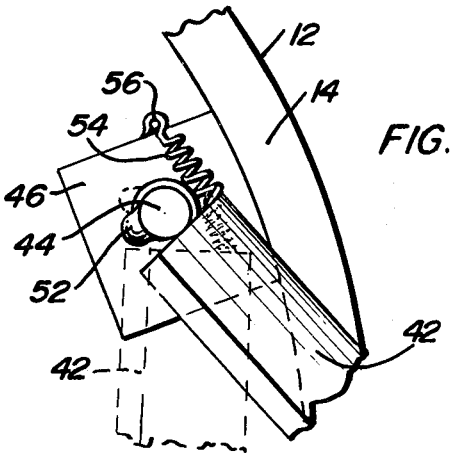
FIG. 5 is a fragmentary plan view illustrating the structure for supporting and spring biasing the trolley stop.

The surface of the stop bar 42 facing the switch elements is inclined upwardly and away from the switch elements as indicated by reference numeral 62 in FIGS. 3 and 5 so that the inclined surface 62 forms a cam surface engaged by the beveled corner 58 of the switch elements 18 or 20 when they move downwardly into the notch 14. The free end 48 of the stop bar 42 includes a beveled corner 64 as illustrated in FIGS. 3 and 4 to facilitate partial entry of the end 48 of the stop bar 42 between the flanges of the trolley wheel 24 as illustrated in FIG. 4 to assure proper association of the stop bar 42 with the trolley wheel 24 to stop the wheel and thus prevent the trolley from rolling off the end of the track section 12 in the area having the notch 14 therein.

Figure 6:
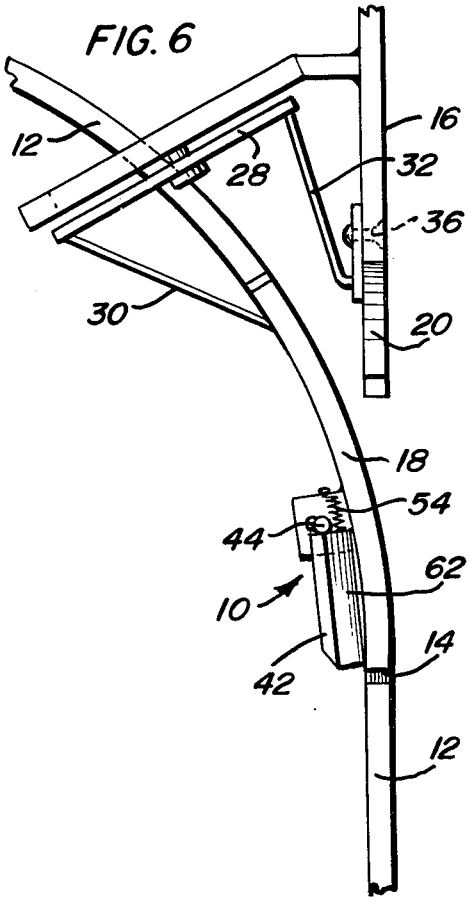
FIG. 6 is a fragmental plan view similar to FIG. 1 illustrating the curved switch element in closed position.

With the stop 10 installed in the overhead track system, as any time one of the switch elements 18 and 20 is closed to provide a continuous track along curved track section 12 or from curved track section 12 onto straight track section 16, the stop bar 42 will be pivoted to its inoperative position along side of the switch element as illustrated in FIG. 6 and FIG. 7. However, at any time one of the switch elements 18 or 20 is pivoted upwardly, as the swinging terminal end portion moves upwardly from the top surface of the notch 14, the bottom edge of the stop bar 42 will move inwardly and progressively into overlying relation to the top edge of the notch thereby assuring that the end 48 of the stop bar 42 will move into position to block the trolley wheel 24 before the swinging end of the switch element moves upwardly a sufficient distance to enable the trolley wheel 24 to drop off the track with this orientation being best illustrated in FIG. 2 in which the stop bar 42 is already in operative position and the switch element 18 has not reached a position to let the trolley wheel 24 drop off the track section 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an overhead track system having a supporting trolley rolling thereon and including a generally horizontal main track having a notch in the upper surface thereof and a generally horizontal branch track having a terminal end aligned with and adjacent the main track, said main track including a switch element pivotal about a horizontal axis into and out of the notch for forming a continuation of the main track when in closed position in the notch, the branch track including a switch element pivotal about a horizontal axis into and out of the notch to form a continuation of a portion of the main track when the branch track switch element is in closed position and the main track switch element is in open position thereby enabling the trolley to be moved along the main track or between the main track and the branch track, a trolley stop mounted on the main track adjacent the notch, means supporting the stop for swinging movement into and out of the notch in response to the absence or presence of one of the switch elements in the notch whereby the stop moves directly into the path of movement of the trolley as a switch element in closed position is moved toward an open position with the stop moving to a position to prevent the trolley from rolling off the end of the track into the notch prior to the switch element moving toward open position sufficiently to enable the trolley to roll off the end of the track thereby positively precluding the trolley from rolling off the end of the track into the notch, said stop including a stop bar extending generally parallel to and slightly above the bottom edge of the notch, said means mounting the stop including a generally vertically disposed pivot pin and bracket lugs rigidly attached to the main track below the notch for pivotally supporting the stop bar for swinging movement in a plane parallel to the bottom edge of the notch, and spring means interconnecting the stop bar and main track for biasing the stop bar towards a position in the path of movement of the trolley and biasing the stop bar against the switch element when in closed position so that as the switch element moves towards open position, the stop bar will progressively move toward a position in the path of movement of the trolley to block movement of the trolley off the end of the track prior to the switch element moving sufficiently toward open position to enable the trolley to roll off the end of the track, said spring means enabling the stop bar to pivot progressively out of the path of movement of the trolley as the switch element approaches closed position with the structure dimensioned such that the stop bar will not move out of the path of movement of the trolley until the switch element approaches a closed position sufficiently to prevent the trolley from rolling off the end of the track, said stop bar including an inclined substantially flat upwardly facing surface facing the switch elements, said switch elements being pivotally supported for movement about said horizontal axes with the swinging ends of the switch elements moving generally in a vertical plane toward and away from closed position thereby engaging the inclined surface of the stop bar and camming it about said vertically disposed pivot pin.

2. The combination as defined in claim 1 wherein one of said track sections and switch elements are curved and the other of said track sections and switch elements is straight with the notch being in the curved track section and the stop bar being mounted on the curved track section along side of the top edge of the notch.

3. The combination as defined in claim 1 wherein said stop bar includes an end spaced from the vertically disposed pivot pin which moves into the path of movement of the trolley, said end of the stop bar being beveled to enable partial entry of the end of the stop bar between the flanges on a flanged wheel supporting the trolley from the track sections thereby assuring proper alignment of the stop bar with the trolley and preventing derailment of the trolley.

4. The combination as defined in claim 3 wherein the lower edge of the stop bar parallels the top edge of the notch and is oriented closely adjacent thereto when the stop bar has its bevelled end between the flanges on a wheel, a depending stop member mounted on said stop bar and depending from the lower edge thereof in offset relation to the lower edge of the stop bar for engaging the track immediately below the notch to limit the movement of the stop bar when the spring means biases the stop bar to closed position, the bevelled end of the stop bar being defined by the inclined end of the stop bar to form a point at its upper corner, said pointed upper corner being bevelled for engagement between the flanges of a flanged wheel, each of the switch elements including a bevelled lower corner engageable with the inclined upwardly facing surface of the stop bar to facilitate camming action of the switch elements against the upwardly facing surface of the stop bar.

* * * * *